US008866686B1

(12) United States Patent
Sikina et al.

(10) Patent No.: US 8,866,686 B1
(45) Date of Patent: Oct. 21, 2014

(54) METHODS AND APPARATUS FOR SUPER-ELEMENT PHASED ARRAY RADIATOR

(71) Applicant: Raytheon Company, Waltham, MA (US)

(72) Inventors: Thomas V. Sikina, Acton, MA (US); Gregory M. Fagerlund, Peabody, MA (US); Jack J. Schuss, Newton, MA (US); Karen A. Rapoza, Townsend, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 13/826,926

(22) Filed: Mar. 14, 2013

Related U.S. Application Data

(63) Continuation of application No. 13/605,390, filed on Sep. 6, 2012, now abandoned, which is a continuation of application No. 12/635,916, filed on Dec. 11, 2009, now abandoned.

(60) Provisional application No. 61/163,262, filed on Mar. 25, 2009.

(51) Int. Cl.
*H01Q 13/10* (2006.01)
*H01Q 13/22* (2006.01)
*H01P 11/00* (2006.01)

(52) U.S. Cl.
CPC ..... *H01Q 13/22* (2013.01); *H01P 11/00* (2013.01)
USPC ..... 343/771; 343/756; 343/770

(58) Field of Classification Search
USPC ..... 343/756, 762, 767, 770, 771
See application file for complete search history.

(56) References Cited

U.S. PATENT DOCUMENTS

| | | | | |
|---|---|---|---|---|
| 3,256,520 | A | 6/1966 | Blitz | |
| 3,564,258 | A | 2/1971 | Feingold | |
| 3,829,862 | A * | 8/1974 | Young | 343/767 |
| 3,995,274 | A * | 11/1976 | Schwartz et al. | 343/771 |
| 4,197,540 | A | 4/1980 | Riggs et al. | |
| 4,216,472 | A | 8/1980 | Albanese | |
| 3,021,521 | A | 2/1982 | Hutchins | |
| 4,725,842 | A | 2/1988 | Mayberry | |
| 4,970,519 | A | 11/1990 | Minnis et al. | |
| 5,646,625 | A | 7/1997 | Burrier | |
| 5,861,837 | A | 1/1999 | Richardson et al. | |
| 5,911,692 | A | 6/1999 | Hussain et al. | |
| 5,966,048 | A | 10/1999 | Thompson | |
| 5,969,667 | A | 10/1999 | Farmer et al. | |

(Continued)

OTHER PUBLICATIONS

Nguyen et al, Controlling Beamwidth of Slot Antenna by Using Parasitic Elements, Proceedings of ISAP'04, Sendai, Japan, pp. 917-920.*

(Continued)

*Primary Examiner* — Dieu H Duong
(74) *Attorney, Agent, or Firm* — Daly, Crowley, Mofford & Durkee, LLP

(57) ABSTRACT

Methods and apparatus for a super-element assembly including a dielectric subassembly having first and second conductive patch conductors extending a longitudinal axis of the super-element assembly, a ridged waveguide having a series of slots formed along its length. The super-element assembly provides a significant advance in the art in module reduction, production cost reduction, and enhanced scan angle response.

20 Claims, 17 Drawing Sheets

(56) References Cited

U.S. PATENT DOCUMENTS

| | | | | |
|---|---|---|---|---|
| 6,043,791 | A | 3/2000 | Kinsey | |
| 6,078,289 | A | 6/2000 | Manoogian et al. | |
| 6,114,997 | A | 9/2000 | Lee et al. | |
| 6,166,701 | A * | 12/2000 | Park et al. | 343/771 |
| 6,218,987 | B1 | 4/2001 | Derneryd et al. | |
| 6,252,542 | B1 | 6/2001 | Sikina et al. | |
| 6,496,158 | B1 | 12/2002 | Ksienski et al. | |
| 6,799,014 | B2 | 9/2004 | Rosen et al. | |
| 6,801,153 | B2 | 10/2004 | Rauch et al. | |
| 6,856,284 | B1 | 2/2005 | Cangiani | |
| 6,933,878 | B1 | 8/2005 | Molyneux-Berry | |
| 6,963,312 | B2 | 11/2005 | Schuneman et al. | |
| 6,977,621 | B2 * | 12/2005 | Kelly et al. | 343/771 |
| 7,180,457 | B2 | 2/2007 | Trott et al. | |
| 7,202,812 | B2 | 4/2007 | Krikorian et al. | |
| 7,250,902 | B2 | 7/2007 | Manoogian et al. | |
| 7,289,079 | B2 | 10/2007 | Rupp et al. | |
| 7,474,262 | B2 | 1/2009 | Alland | |
| 7,477,921 | B2 | 1/2009 | Shattil | |
| 7,492,313 | B1 | 2/2009 | Ehret et al. | |
| 2004/0080463 | A1 | 4/2004 | Jeong | |
| 2005/0146477 | A1 | 7/2005 | Kelly et al. | |
| 2006/0273952 | A1 | 12/2006 | Krikorian et al. | |
| 2007/0085727 | A1 | 4/2007 | Backes et al. | |
| 2008/0204318 | A1 | 8/2008 | Thomas et al. | |
| 2008/0272959 | A1 | 11/2008 | Meharry et al. | |
| 2012/0319900 | A1 | 12/2012 | Johansson et al. | |

OTHER PUBLICATIONS

Notice of Allowance dated Dec. 16, 2011, U.S. Appl. No. 12/466,066, 10 pages.

Office Action in U.S. Appl. No. 12/635,893 dated Aug. 26, 2011, 6 pages.

Response to Office Action in U.S. Appl. No. 12/635,893 dated Aug. 26, 2011, filed on Nov. 21, 2011, 9 pages.

Notice of Allowance dated Dec. 7, 2011, U.S. Appl. No. 12/635,893, 5 pages.

RCE and Amendment filed Mar. 6, 2012 in U.S. Appl. No. 12/635,893, 7 pages.

Office Action in U.S. Appl. No. 12/635,893 dated Mar. 15, 2012, 6 pages.

Response to Office Action in U.S. Appl. No. 12/635,893 dated Mar. 15, 2012, filed on Aug. 14, 2012, 4 pages.

Office Action in U.S. Appl. No. 12/635,893 dated Oct. 10, 2012, 5 pages.

Response to Office Action in U.S. Appl. No. 12/635,893 dated Oct. 10, 2012, filed on Apr. 9, 2013, 6 pages.

Notice of Allowance in U.S. Appl. No. 12/635,893 dated Apr. 19, 2013, 6 pages.

Office Action in U.S. Appl. No. 12/730,533 dated Jun. 7, 2012, 6 pages.

Response to Office Action in U.S. Appl. No. 12/730,533 dated Jun. 7, 2012, filed Jul. 9, 2012, 1 page.

Notice of Allowance in U.S. Appl. No. 12/730,533 dated Aug. 1, 2012, 8 pages.

U.S. Appl. No. 12/730,533, filed Mar. 24, 2010, Schuss et al.

U.S. Appl. No. 12/635,893, filed Dec. 11, 2009, Schuss et al.

U.S. Appl. No. 13/662,641, filed Oct. 29, 2012, Schuss et al.

U.S. Appl. No. 13/945,197, filed Jul. 18, 2013, Schuss et al.

P.W. Hannan, M.A. Balfour, Simulation of a Phased-Array Antenna in Waveguide, IEEE Transactions on Antennas and Propagation, pp. 342-353, Mar. 11, 2009 downioaded from IEEE.

U.S. Appl. No. 12/635,893 filed on Dec. 11, 2009, 396 pages.

U.S. Appl. No. 13/945,197 filed on Jul. 18, 2013, 180 pages.

U.S. Appl. No. 12/730,533 filed on Mar. 24, 2010, 345 pages.

U.S. Appl. No. 13/662,641 filed on Oct. 29, 2012, 130 pages.

U.S. Appl. No. 13/329,682 Office Action dated Mar. 31, 2014, 11 pages.

* cited by examiner

Layer Stack Up Dimensions

| Layer | Material | Thick (in.) | $\varepsilon_r$ | $\delta_d$ |
|---|---|---|---|---|
| 1 | Foam (Roh 71) | 0.317 | 1.08 | 0.0003 |
| 2 | Adhesive | 0.005 | 2.2 | 0.002 |
| 3 | Taconic RF-43 | 0.01 | 4.3 | 0.0033 |
| 4 | Adhesive | 0.005 | 2.2 | 0.002 |
| 5 | Foam (Roh 71) | 0.26 | 1.08 | 0.0003 |
| 6 | Adhesive | 0.005 | 2.2 | 0.002 |
| 7 | Taconic RF-43 | 4.3 | 4.3 | 0.0033 |

410 — Lower Patch Width: 0.857
412 — Upper Patch Width: 0.3
Patch Thickness 0.0007

Lower Patch Strip on Bottom of Layer 3
Upper Patch Strip on Top of Layer 7

FIG. 6C
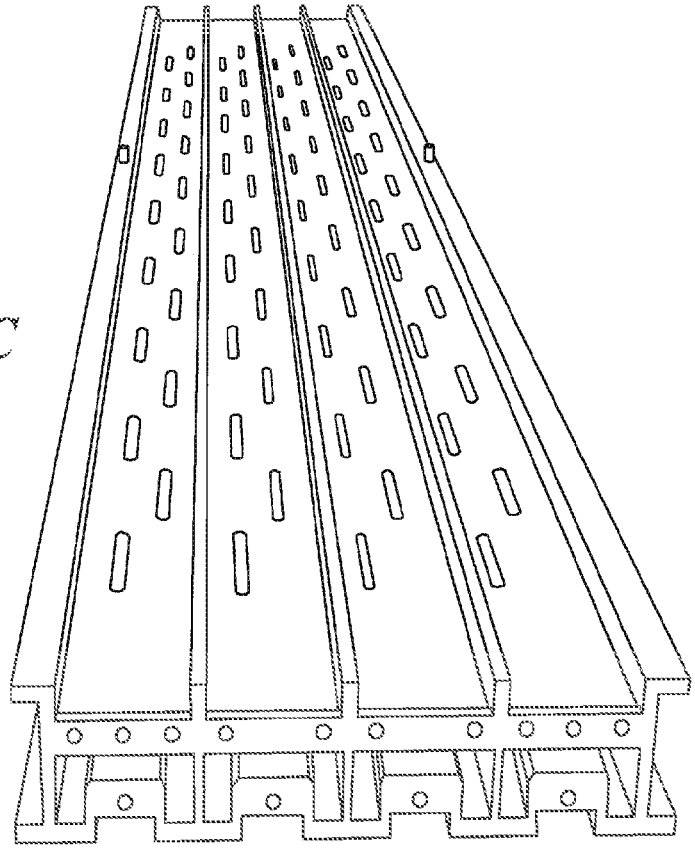
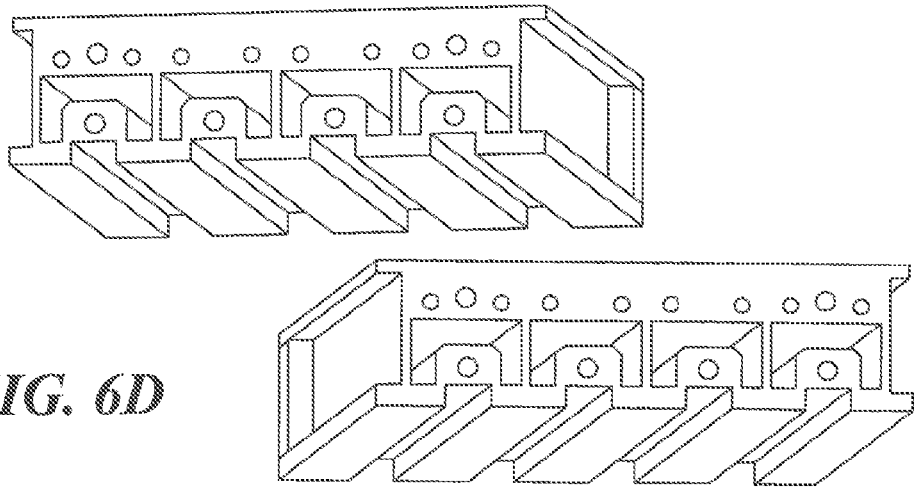
FIG. 6D

METHODS AND APPARATUS FOR SUPER-ELEMENT PHASED ARRAY RADIATOR

CROSS REFERENCE TO RELATED APPLICATIONS

The present application is a continuation of U.S. patent application Ser. No. 13/605,390 filed on Sep. 6, 2012, which claims the benefit of U.S. patent application Ser. No. 12/635,916 filed on Dec. 11, 2009, which claims the benefit of U.S. Provisional Patent Application No. 61/163,262, filed Mar. 25, 2009, all of which are incorporated herein by reference in their entirety.

BACKGROUND

As is known in the art, phased array radars have a number of advantages over other types of radar systems while having certain potential disadvantages, such as high cost and complexity. One persistent fundamental limitation to the design and operation of phased array antennas used in radars and communication systems is the scan loss, or the accumulated losses associated with scan to large spatial angles, typically sixty degrees or more from the aperture surface normal. Another intrinsic limitation arises from the production cost of modern phased array antenna systems, which is generally governed by the unit cost and quantity of radiators and the transmit (Tx) and or receive (Rx) modules used in the antenna array.

SUMMARY

The present invention provides methods and apparatus for a super-element array radiator for phased array radar systems. The inventive radiator provides a significant advance over known super-element radiators in transmit and receive module count reduction, array production cost reduction, and enhanced scan angle response. While exemplary embodiments of the invention are shown and described in conjunction with certain array dimensions, operational frequency, and structures, it is understood that the invention is applicable to phase array radars in general in which cost reduction and optimal scan response are desirable.

In one aspect of the invention, a super-element radiator assembly comprises a ridged waveguide having a longitudinal axis aligned with a longitudinal axis of the super-element radiator assembly, a series of slot couplers formed in the waveguide, and a dielectric assembly adjacent the ridged waveguide disposed between opposing conductive walls defining a long slot along a length of the super-element radiator assembly, the dielectric assembly comprising a first resonant conductive strip and a second resonant conductive strip, a first dielectric foam layer adjacent the waveguide, a first dielectric layer adjacent the first dielectric foam layer, a second dielectric foam layer adjacent the first dielectric layer, and a second dielectric layer adjacent the second dielectric foam layer, the first and second resonant strips being aligned along the longitudinal axis of the super-element radiator assembly and separated by the second dielectric foam layer.

The assembly can further include one or more of the following features: the first resonant conductive strip is disposed on the first dielectric layer, the second resonant conductive strip is disposed on the second dielectric layer, the first and second dielectric foam layers are thicker than the first and second dielectric layers, the slot couplers are offset from the longitudinal axis of the waveguide, the offset varies over a length of the super-element assembly, the conductive walls are extruded aluminum, the super-element forms a part of an aperture of a planar and/or conformal phased array radar, a structure of the super-element assembly provides a mode-filter, the long slot provides single and multiple forms of polarization control, including single linear, dual linear, single circular, and dual circular polarizations, the super-element assembly includes below resonance and above resonance components to balance the frequency and scan dependent response of the assembly, the super-element assembly includes unit cells combined by a series-fed network to form a super-element for a scanned and fixed beam type, the series-fed network is reactive, the super-element forms a part of a system having a terminal VSWR is no greater than 1.05, and a total electrical loss is 1.8 dB or less for scan angles up to 65 degrees from an aperture surface normal when operated within S-Band frequencies over a 10% bandwidth.

In another aspect of the invention, a method comprises providing a super-element radiator assembly including a ridged waveguide having a longitudinal axis aligned with a longitudinal axis of the super-element radiator assembly, a series of slot couplers formed in the waveguide, and a dielectric assembly adjacent the ridged waveguide disposed between opposing conductive walls defining a long slot along a length of the super-element radiator assembly, the dielectric assembly comprising a first resonant conductive strip and a second resonant conductive strip, a first dielectric foam layer adjacent the waveguide, a first dielectric layer adjacent the first dielectric foam layer, a second dielectric foam layer adjacent the first dielectric layer, and a second dielectric layer adjacent the second dielectric foam layer, the first and second resonant strips being aligned along the longitudinal axis of the super-element radiator assembly and separated by the second dielectric foam layer.

The method can further include one or more of the following features: the first resonant conductive strip is disposed on the first dielectric layer, the second resonant conductive strip is disposed on the second dielectric layer, the first and second dielectric foam layers are thicker than the first and second dielectric layers, the slot couplers are offset from the longitudinal axis of the waveguide, the offset varies over a length of the super-element assembly, the conductive walls are extruded aluminum, the super-element forms a part of an aperture of a planar and/or conformal phased array radar, a structure of the super-element assembly provides a mode-filter, the long slot provides single and multiple forms of polarization control, including single linear, dual linear, single circular, and dual circular polarizations, the super-element assembly includes below resonance and above resonance components to balance the frequency and scan dependent response of the assembly, the super-element assembly includes unit cells combined by a series-fed network to form a super-element for a scanned and fixed beam type, the series-fed network is reactive, the super-element forms a part of a system having a terminal VSWR is no greater than 1.05, and a total electrical loss is 1.8 dB or less for scan angles up to 65 degrees from an aperture surface normal when operated within S-Band frequencies over a 10% bandwidth.

BRIEF DESCRIPTION OF THE DRAWINGS

The foregoing features of this invention, as well as the invention itself, may be more fully understood from the following description of the drawings in which:

FIGS. 6A-D show a pictorial representation of a super-element assembly with FIG. 6B showing the super-element with a form core assembly;

DETAILED DESCRIPTION

Figure 1:
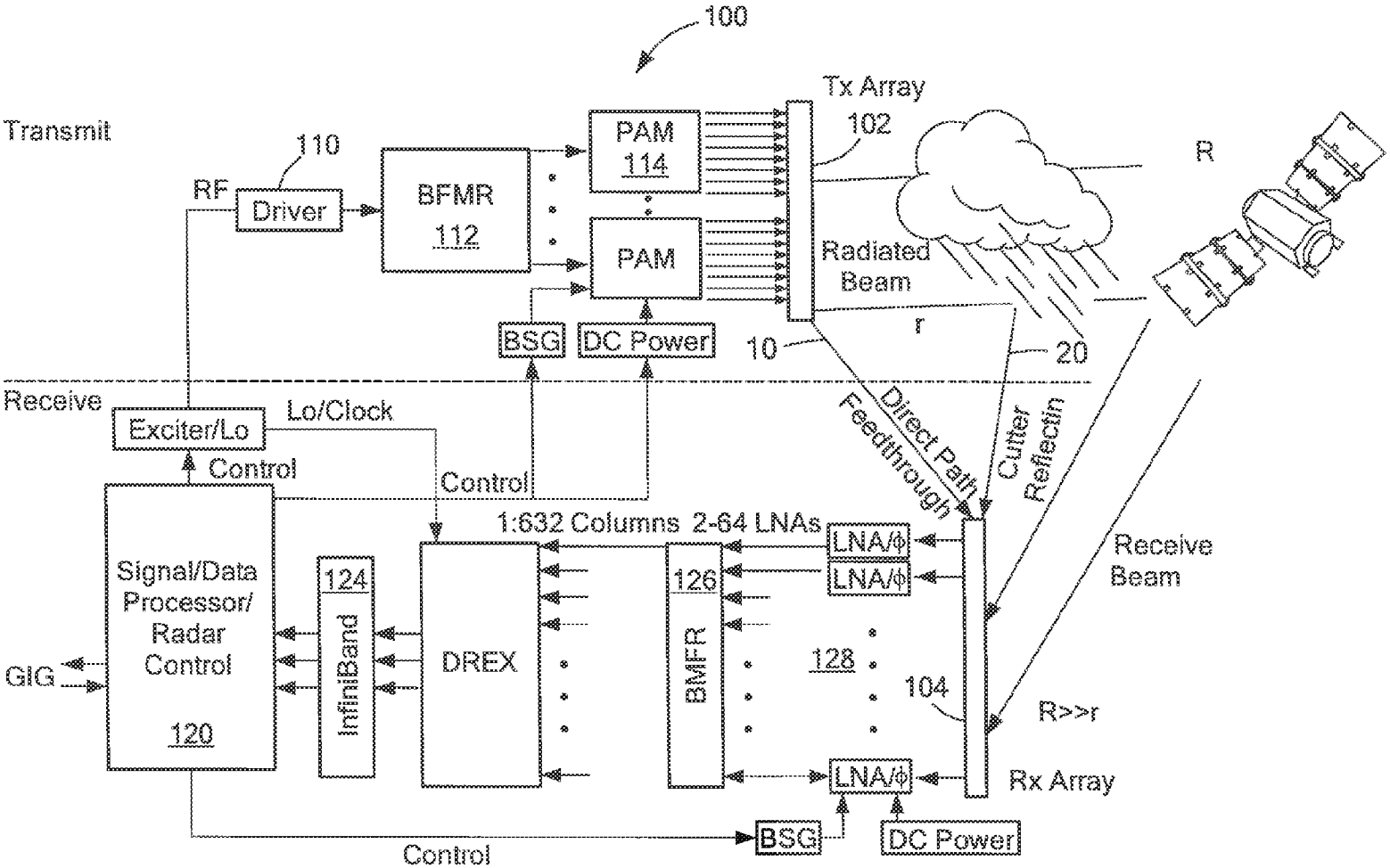
FIG. 1 shows an exemplary phased array radar system having super-elements with radiator elements in accordance with exemplary embodiments of the invention.

FIG. 1 shows an exemplary phased array radar system 100 having super-element radiators in accordance with exemplary embodiments of the present invention. In one embodiment, the radar system is optimized for tracking satellite targets. The phased array radar 100 has separate transmit and receive arrays 102, 104 with a remote target illustrating direct path feedthrough 10 and feedthrough 20 from a near object in the form of a weather formation. The system 100 includes on the transmit side a driver 110 coupled to a digital beamformer 112 feeding a PAM (Power Amplifier Module) 114, which energizes the transmit array 102. The receive side includes a signal data processor control module 120 coupled to a digital receive system 122 via a universal I/O device 124, such as InfiniBand. The receive beamformer 126 receives input from the low noise amplifiers 128, which are coupled to the receive array 104. The system 100 includes receive and/or transmit arrays having an exemplary super-element radiator in accordance with exemplary embodiments of the invention.

In an exemplary embodiment, the transmit aperture 102 and separate receive aperture 104 are sized to enable the radar system to track targets from 100 km to 42,000 km in altitude. In one particular embodiment, the system includes a transmit aperture of about 200 m by 14 m and a receive aperture of about 215 m by 27 m, both of which can be elliptical. The challenges associated with a phased array of this size in cost, module count, and complexity, will be readily apparent to one of ordinary skill in the art.

Before describing exemplary embodiments of the inventive super-element radiator, some information is provided. As is known in the art, a super-element radiator comprises a number of individual radiator elements coupled to a common transmission line. This can be realized in a number of topologies, including configurations of waveguides with slot radiators, configurations of radiators fed by stripline feeds, and configurations of oversized (>λ/2) waveguide radiators. Generally, the scan volume associated with super-element radiators is limited to a relatively narrow scan range located near the aperture surface normal or boresight. Exemplary embodiments of the invention provide a significant advance in the art by achieving very low scan loss at scan angles exceeding sixty degrees, reducing the production cost of the radiator by as much as an order of magnitude, and significantly reducing the number of transmit and/or receive modules used. The combination of the above factors can effectively reduce the array production cost by a factor of ten or more, representing a significant potential expansion for contemporary phased radar and communication systems.

Figure 2:
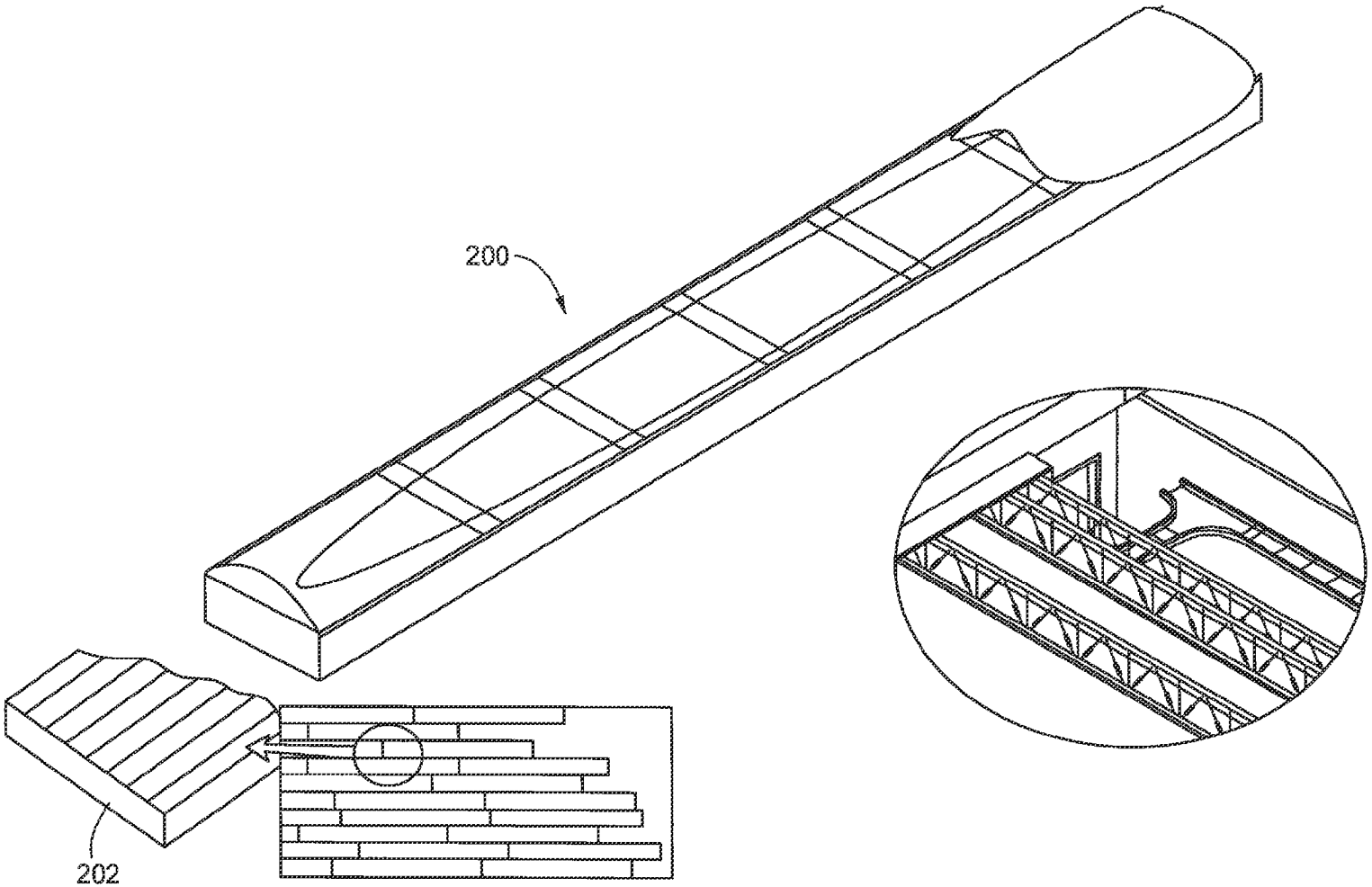
FIG. 2 is a pictorial representation of a super-element forming a part of an antenna aperture.

FIG. 2 shows an array implementation using exemplary embodiments of the super-element radiator. An array 200 includes a number of super-element radiators 202 having a number of radiator elements. The array uses a frequency-scanned super-element approach that provides significant benefits. Unlike known configurations, exemplary embodiments of the invention use a matched resonance design and a zero cutoff frequency or traveling wave aperture spatial interface to a series ridged waveguide feed network. While quite complex from an electromagnetic standpoint, the elegant configuration of the super-element components enable cost-effective manufacture. For example, assembly procedures require minimal labor content, the effective use of extrusion metallurgy, and multi-layered dielectric subassemblies in an integrated design.

Figure 3:
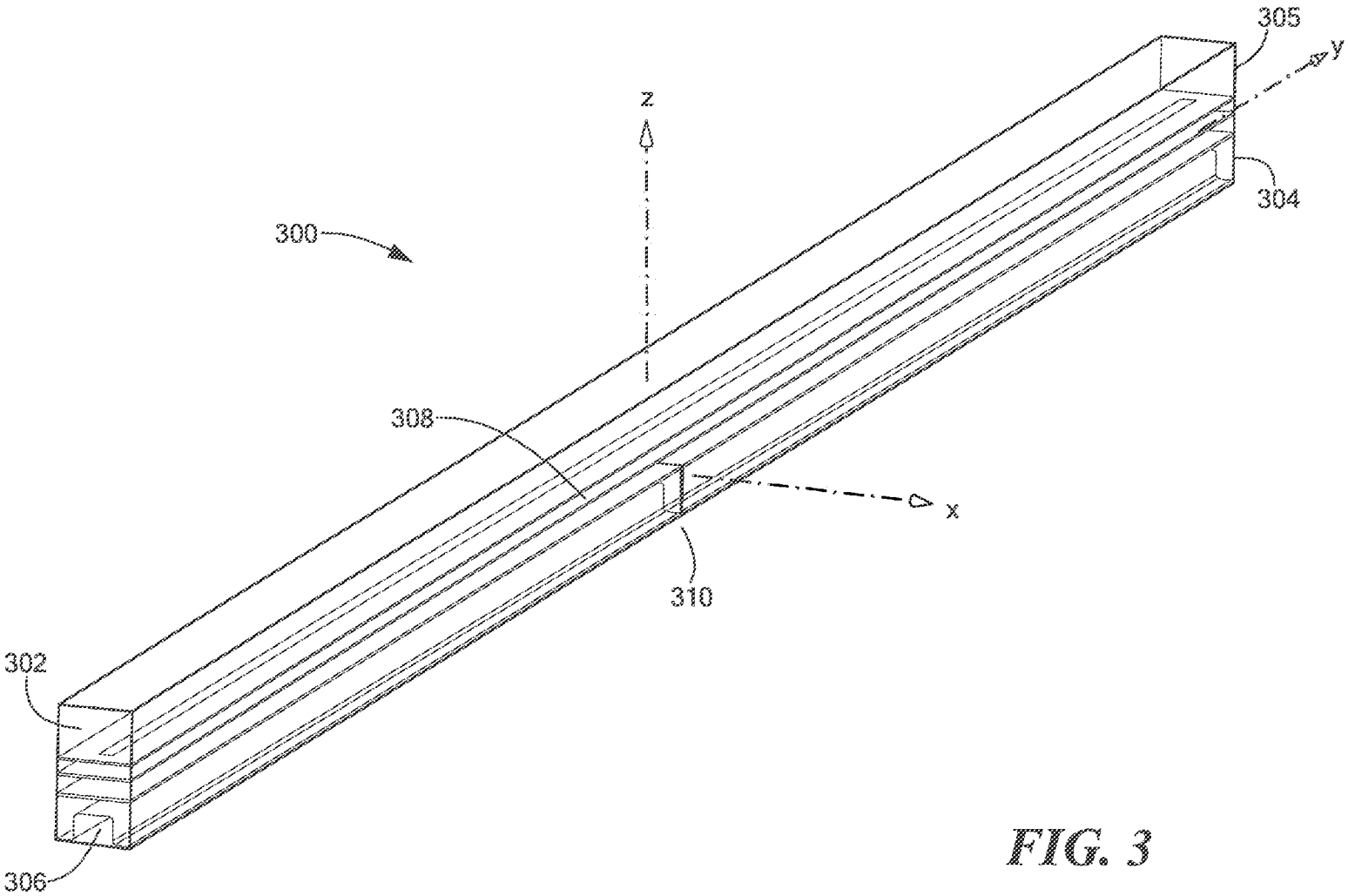
FIG. 3 is a diagrammatic representation of a super-element.
Figure 4:
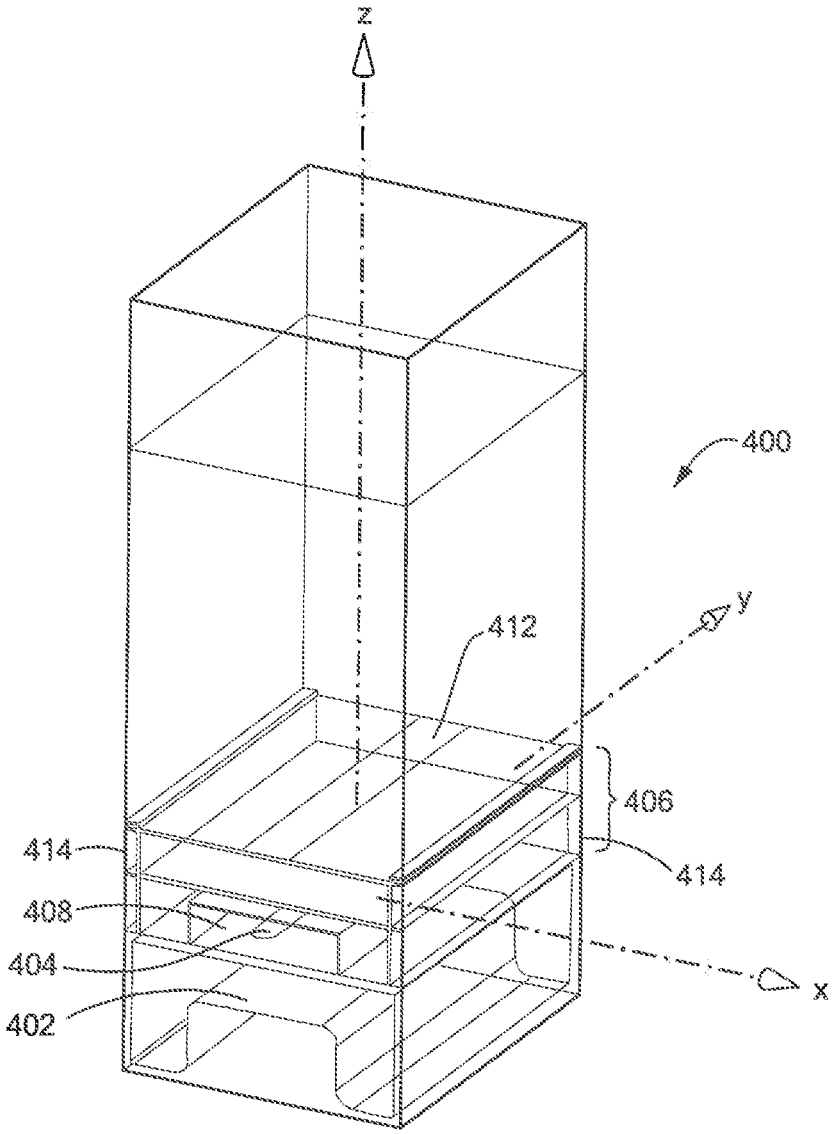
FIG. 4 is a depiction in model form of a unit cell of a super-element.

FIG. 3 shows an exemplary super-element radiator 300 and FIG. 4 shows a unit cell 400 in the super-element. The super-element 300 includes an input port 302 and a termination port 304. Simulated radiation boundaries 305 are disposed in the xz plane above a ridged waveguide 306 that extends along an axis of the super-element. Simulated master/slave walls 308 are located on the sides in yz plane above the waveguide 306. Note that a split 310 in the waveguide is shown for modeling purposes to help the meshing process.

FIG. 4 shows some further detail for a unit cell 400 of the radiator. The unit cell includes a single ridge waveguide 402, which is well known in the art. With a feed port at one end of the super-element and a termination at the other end, the super-element acts as a transmission line distributing electromagnetic power to each of the unit cells. The upper conductive wall of the waveguide is interrupted with a slot coupler 404 (see FIG. 6A). A dielectric assembly 406 is disposed over the waveguide 402. In an exemplary embodiment, the dielectric assembly includes a channel 408 and a layer stack shown in detail in FIG. 5, which shows exemplary dimensions for the unit cell 400. The dielectric assembly includes first (shown in FIG. 5) and second conductive strips or patches 410, 412 located at first and second heights above the coupling slot 404. The resonant conductive strips 410, 412 are suspended with low loss foam dielectric materials in a single sub-assembly. In an exemplary embodiment, the strips 410, 412 are continuous over the full length of the super-element. Conductive walls 414 enclose the dielectric and strip subassembly, also running the full length of the super-element. The conductive walls 414 form a long slot radiator, with an opening extending the full length of the super-element. As shown in FIG. 5, the coupler 404 is approximately 1.52 inches long, 0.15 inches wide, with semi-circular ends, and is cut out of the full height of the upper waveguide wall.

Figure 6A:
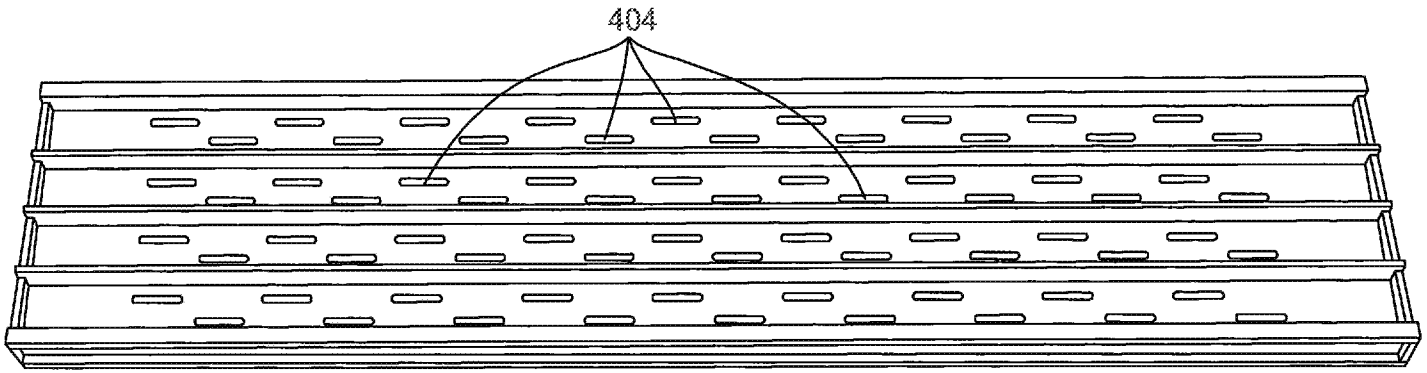
Figure 6B:
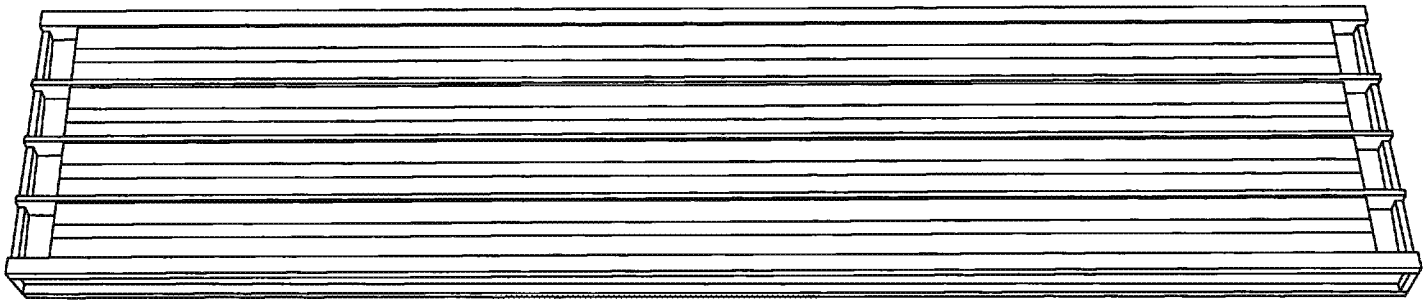

FIGS. 6A-D show pictorial representations of super-element radiators in accordance with exemplary embodiments of the invention. FIGS. 6A, 6C, and 6D show the super-element assembly without the dielectric assembly. FIG. 6B shows the super-element assembly with dielectric/foam core assemblies. FIG. 6D shows an exemplary coax to waveguide transmission. It is understood that any suitable transition to waveguide can be used.

Figure 5A:
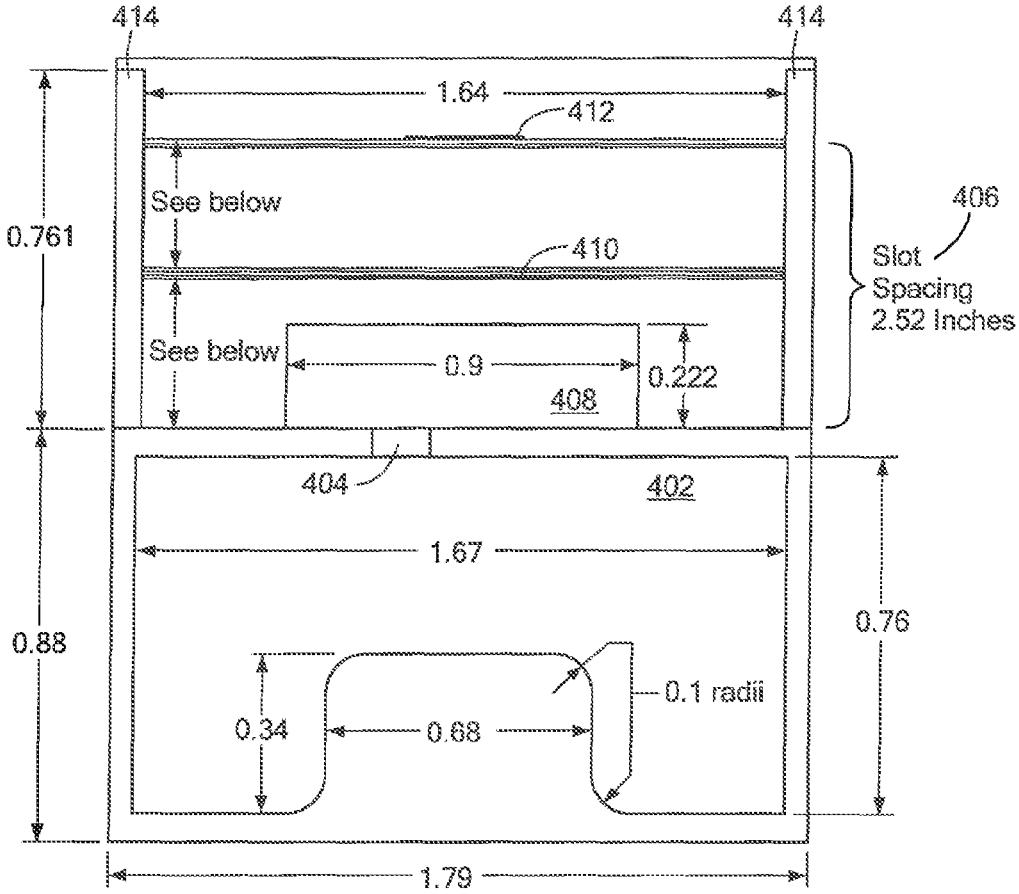
FIG. 5A is a cross-sectional view of a super-element and FIG. 5B is a top view of a portion of a super-element.
Figure 5B:
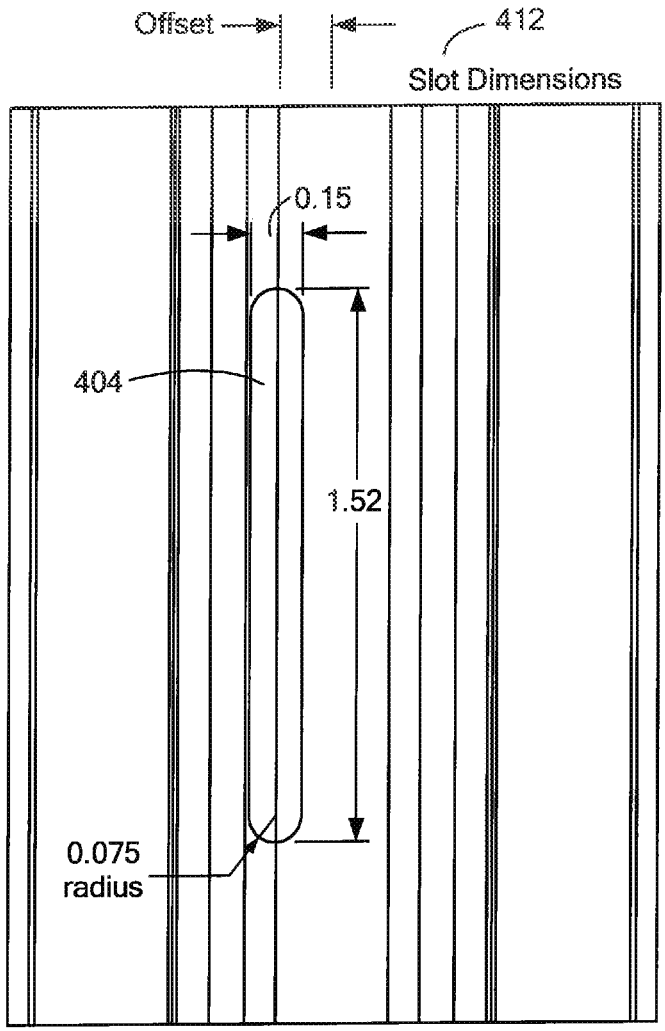
Figure 7:
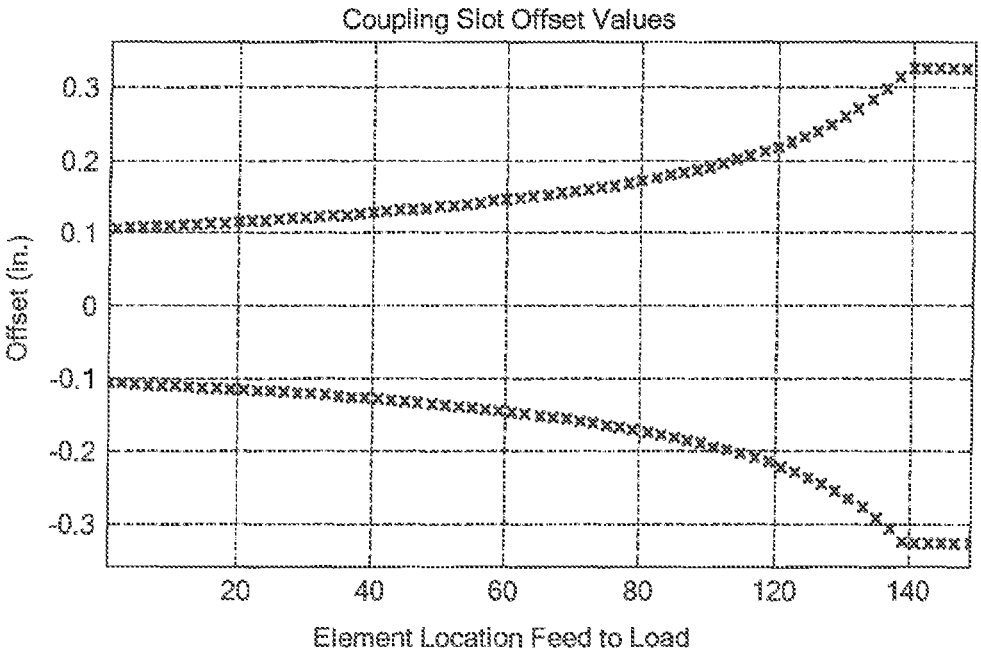
FIG. 7 is a graphical depiction of coupling offset value versus the element location along the super-element.

As shown in FIGS. 5A and 6A, for example, the slots 404 are offset from a longitudinal axis of the super-element assembly, i.e., the y axis of FIG. 3. Slot offset values, such as shown in FIG. 5A and FIG. 6A, vary from the feed to the load end, following a logarithmic curve with staggered or opposing slot positions relative to the waveguide center line for each unit cell, as shown in FIG. 7. The offsets are shown for a 129-element radiator.

Functionally, the long slot has a resonant frequency of approximately zero Hertz, giving it broadband characteristics. The slot coupler 404 has a resonance occurring below the operating band, producing a dispersive effect. In an exemplary embodiment, the operating frequency of the radar is from about 3 GHz to about 4 GHz. It is understood that other operating frequencies can be used. Since the strip conductors 410, 412 are sized to produce a resonance considerably above the operating frequency band, the end result is a balanced resonance system. This means that the radiating element can operate over a large operating band (16% or greater) with relatively stable electrical performance over the operating frequency range and scan volume. Typically, it is these two domains, frequency and scan, that produce performance degradation in volumetric scan phased array radiators.

The long slot interface to space is essentially non-resonant because its resonance frequency is far away from the operating band. Because of its dimensions and boundary conditions, the long slot operates as a broadband impedance element and transition to free space. It essentially acts as a traveling wave component with radiation properties that are also largely scan invariant. The scan invariance arises from the traveling wave nature of the long slot interface, which is supported by the limited set of propagating modes allowed by the boundary conditions. The radiator integrates this long slot feature with the impedance strips 410, 412, slot coupler 404, and the single ridged waveguide 402 into a simple assembly that is readily produced by metal extrusion techniques. Using the inventive embodiments, most of the metal conductors needed to set up the necessary boundary conditions are produced in a simple and low cost process.

The inventive super-element radiator uses integrated design features to achieve very low scan losses including a zero-cutoff frequency long slot interface to free space, a balanced resonance system with multiple elements having resonant frequencies that are both above and below the operating frequency band; and a series-fed network with or without frequency scan characteristics.

These features form a set of boundary conditions that act as the transition for the super-element input port to the scan volume used in free-space. The radiator geometry produces a zero cut-off frequency, unlike many antenna types used for similar applications that often produce resonance within the operating band. In exemplary embodiments of the invention, the resonant frequency of the component directly connected with the free-space boundary condition has a resonance frequency at zero Hertz. The balanced resonance system uses components, such as the long slot or traveling wave radiator interface, the coupling aperture, and suspended strip conductors to balance the impedance resonances produced by the system. The strip conductors are also suspended with relatively thin but high dielectric materials. These act to control the unit cell mode impedance in conjunction with the strip conductors and the long slot boundary conditions. In addition, the series-fed network is one implementation that cascades many of the radiators into a single super-element with a common transmission line. Many related feed networks can be effectively used with the inventive design approach, producing similar benefits, including equal line length networks, corporate networks, as well as the illustrated series-fed network. In exemplary embodiments, the series-fed network is reactive.

The use of a balanced resonance system provides a wide operating band. In one implementation, the operating band is at least sixteen percent. The bandwidth of comparable conventional phased array radiators is considerably less, often five percent or less.

Figure 8:
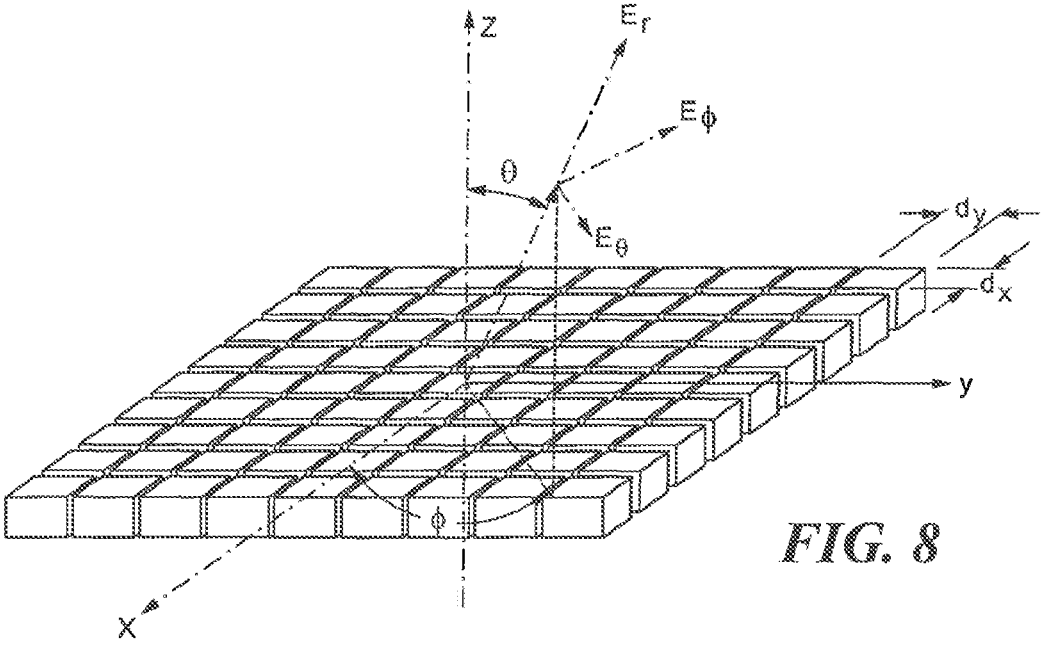
FIG. 8 shows a three-coordinate system useful for depicting phase array radiator operation.
Figure 9:
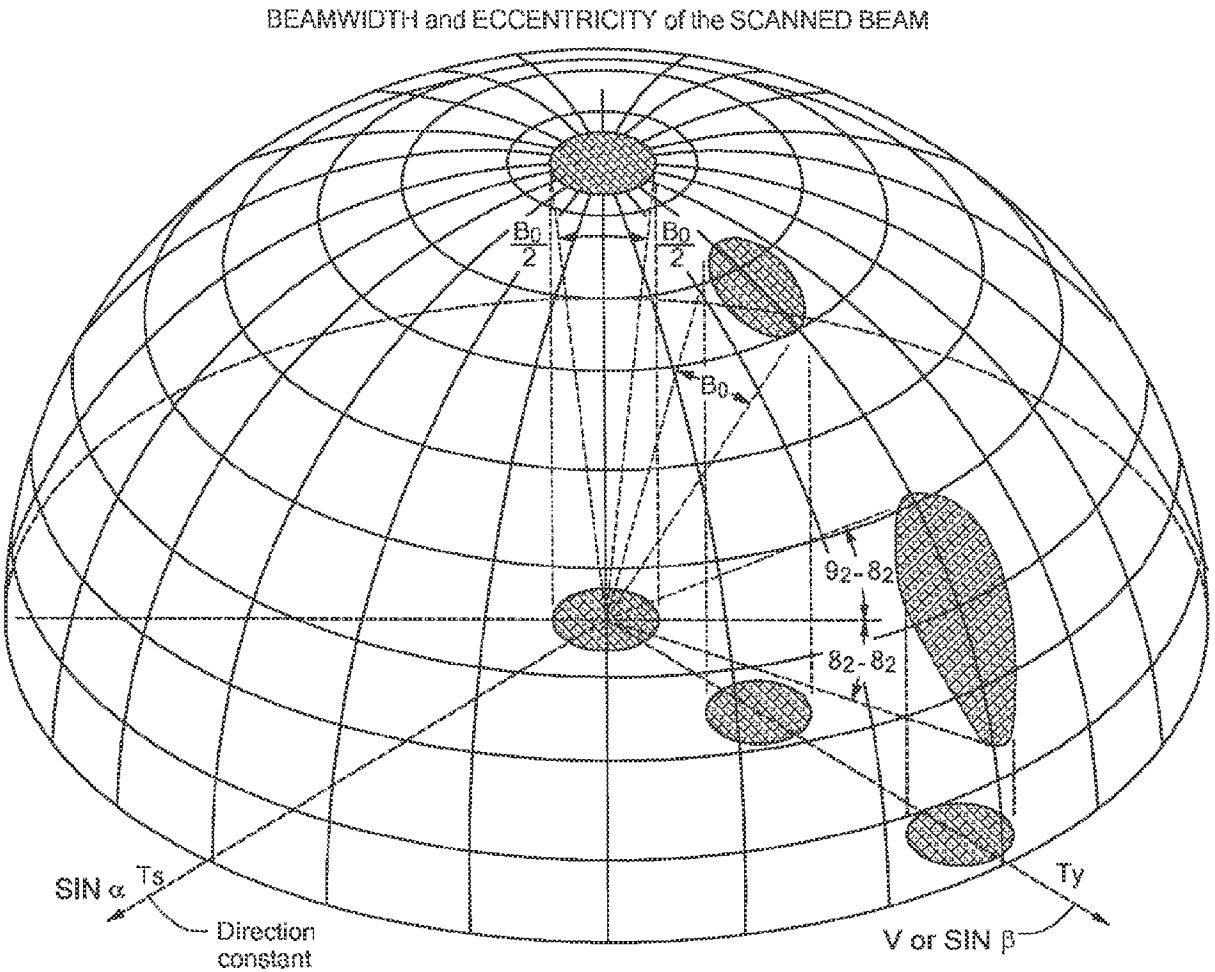
FIG. 9 is a unit sphere representation of a radiating antenna far field radiation beam as it intersects the sphere in angle space.

Low scan loss reduces the antenna system production cost. Since system operation is often governed by the maximum scan condition, the reduced scan loss is critically linked to a reduction in the antenna aperture size. For example, many radar systems are sized with a scan loss often represented by $10 \log_{10}(\cos^{1.5} \theta)$, where $\theta$ is the angle measured between the aperture surface normal and the main beam position at the maximum scan angle, as shown in FIG. 8. The three coordinate systems used to depict phased array radiators in operation include the x, y, z coordinate grid locates the radiating elements within the aperture plane (x-y). The r, $\theta$, $\phi$ system locates the far field or radiation coordinates, and the related $E_r$, $E_\theta$, $E_\phi$vector coordinates identify the components of the radiated electric field. One component of the scan loss is caused by the projection of a planar antenna aperture towards the object located at the maximum scan angle. Termed the aperture projection effect, this is responsible for a loss of $10 \log_{10}(\cos \theta)$, and this can be seen by means of a visual representation of the far field radiation beam in both angle and sine space, as shown in FIG. 9. The unit sphere representation of the radiating antenna's far field radiation beam, both as it intersects the sphere in angle space, and in its projection onto the xy plane, representing the same beam in sine space. For a planar antenna scanned to 60 degrees, the aperture projection loss is 3.0 dB, and is intrinsic. The total scan dependent losses for such an antenna are $10 \log_{10}(\cos^{1.5} \theta)$, or 4.5 dB. Of this, 1.5 dB represents the antenna scan dependent loss. Exemplary embodiments of the invention reduce these losses to approximately $10 \log_{10}(\cos^{1.05} \theta)$, representing a scan dependent loss of 0.3 dB, resulting in a 1.0 dB or greater reduction. The illustrative embodiments also have low Ohmic losses, which make a small contribution to the total loss.

The inventive super-element radiator embodiments provide low loss capability for scan angles exceeding sixty degrees, representing additional scan dependent loss benefits. At 67.8 degrees scan, the radiator has an estimated total loss of 0.5 dB, in one implementation. This represents scan dependent losses and the generally scan independent Ohmic losses. Typical losses for similar conventional radar antennas are represented by $10 \log_{10}(\cos^{1.5} \theta)$, or 2.1 dB. To these, additional Ohmic losses of 0.75 dB are added, giving a total loss of to approximately 2.85 dB. The difference between the typical known radar antenna losses and the inventive radiator is as much as 2.35 dB for one-way transmission.

Inventive embodiments of the radiator also provide low cross-polarization. The radiator produces a single linear electric field polarization, even if dual linear, single circular, and dual circular polarizations are also possible. The long slot interface to space sets up boundary conditions that allow only Electric fields that are Transverse to the direction of propagation (TE) to exist. The radiator therefore effectively acts as a mode filter, preventing the propagation of propagating modes that produce cross-polarization. With the boundary condition restraint on these cross-polarized fields, the total cross-polarized field content is constrained to very low levels. As a result, the cross-polarized radiation content is generally 30 to 40 dB less than the co-polarized fields. These results are consistent, and generally held over much of the antenna scan volume. At large scan angles, cross-polarization of an ideal planar radiator is known to increase as the scan moves towards the diagonal planes, while in the principal planes the cross-polarization is very small. The subject invention is no exception to this intrinsic feature, and evidences a worst case cross-polarization magnitude of −16 dB at its maximum scan angles. Since the cross-polarized field content is low, the losses due to polarization mismatch are very low, in the order of 0.11 dB.

As noted above, a super-element includes a number of radiating elements connected together via a single transmission line to each transmit, receive or T/R module. Although this generally produces a limited antenna scan volume, objectives for space surveillance and horizon search radars can be met because of the invention's wide scan angle capability. An immediate advantage is a direct reduction in the module count. And, since module costs are a major fraction of the total antenna system costs, significant cost reductions become available. In one implementation, the super-element reduces the active module count by 130 in receive mode and 65 in transmit mode, for an average system hardware cost reduction of approximately 100:1.

Since super-elements have a limited scan volume due to the greater than 72 element spacing between phase control points, its effectiveness should be maximized. The inventive phased array radiator extends the scan volume to cover a wide angle surveillance fence while maintaining its high performance and low cost features.

Figure 10:
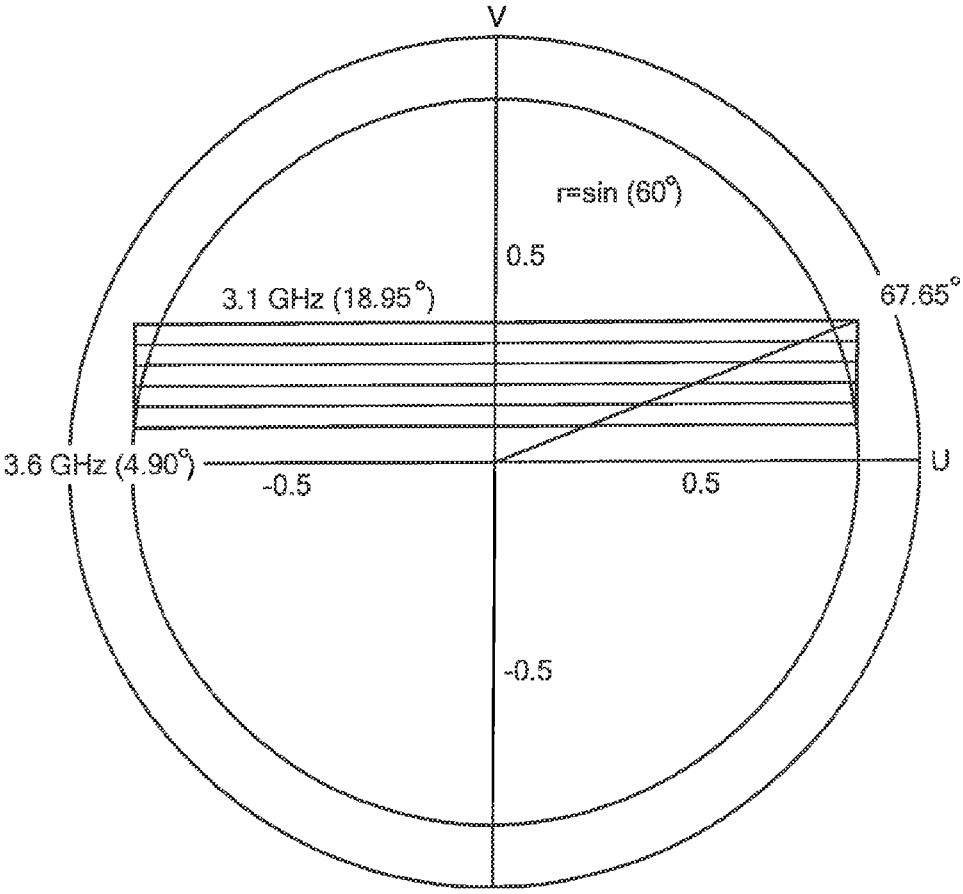
FIG. 10 shows a sine space coordinate representation of an antenna scan volume.
Figure 11A:
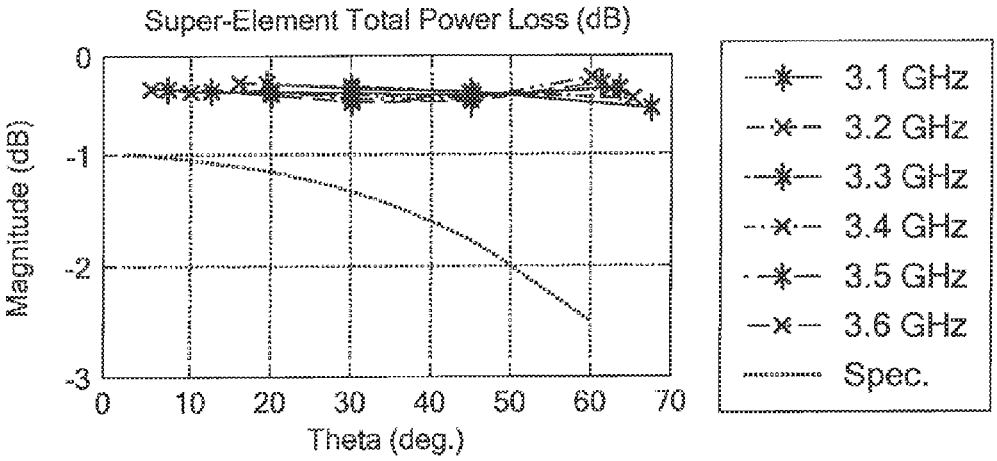
FIGS. 11A-D show super-element total power loss, termination power loss, aperture efficiency, and array peak sidelobe level.
Figure 11B:
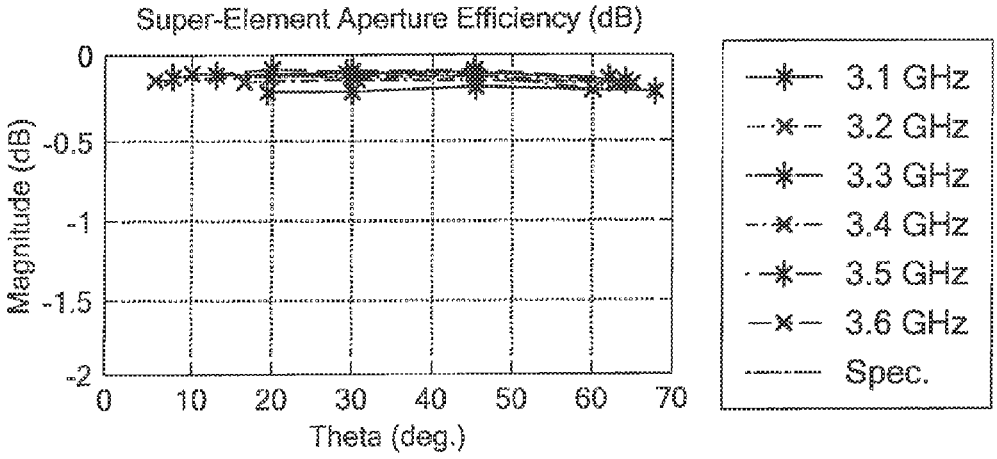
Figure 11C:
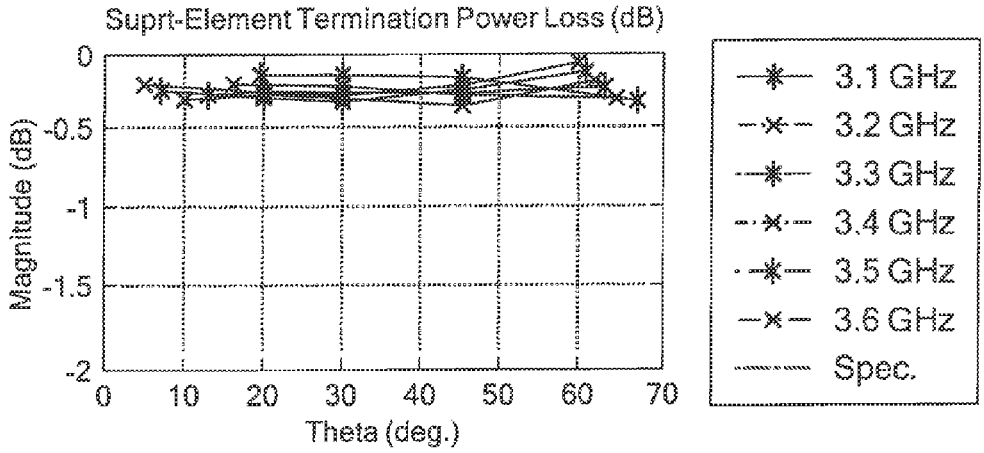
Figure 11D:
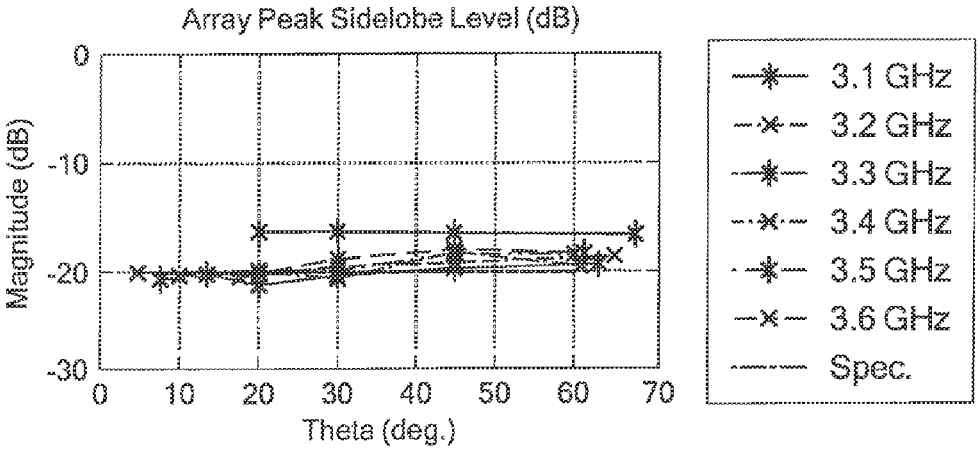

The phased array antenna scan volume represents the angular reach of the antenna system within its performance requirements. Using the sine space method indicated above, this can be illustrated in a compact manner, as shown in FIG. 10. The far field radiation can be scanned to locations along the v-axis by operating at the frequencies shown, so at 3.1 GHz, the beam is scanned to approximately 19 degrees from the surface normal. Independently, the beam may be scanned along the u-axis by adjusting its aperture phase state at the super-element ports. The total scan volume extends beyond a ring located 60 degrees from the aperture surface normal or what is often termed the antenna boresight.

The resulting total scan volume represents a significant surveillance or coverage volume and is displaced from boresight (center) to avoid resonance effects at boresight scan. The combinations of operating frequency and phase scan are used to position the antenna beam as needed within the total scan volume.

Typical known volume scan radiating apertures have a significant reflection coefficient at their terminal ports because of frequency and scan dependent impedance mismatch. In general, antenna radiators that are scanned to up to sixty degrees from the aperture surface normal evidence a VSWR (voltage standing wave ratio) of 2:1, which means that the reflection coefficient is −9.5 dB. In systems with degraded performance, the VSWR and reflection coefficient can increase considerably. This effect degrades antenna performance in several ways including introducing losses, such as impedance mismatch loss, which is typically 0.51 dB for a 2:1 VSWR, and considerably more for degraded systems. A significant reflection coefficient also can degrade the system equivalent noise temperature, thus decreasing the system signal to noise ratio.

The inventive radiator is significantly different than typical phased array antennas because of the very low terminal VSWR, i.e., no greater than 1.05:1 under all scan and operating frequency conditions, e.g., S-band. This means that the reflection coefficient is approximately −32 dB or less and the impedance mismatch loss is less than an almost trivial 0.003 dB. This also means that the system noise effects induced by radiator impedance mismatch are limited to its Ohmic losses, since impedance mismatch losses are essentially non-existent.

There are few, if any good examples of known low manufacturing cost and high performance phased array radiators, because such systems have been mutually exclusive. Low cost radiators often do not cover a substantial scan volume or scan at all. Whereas, volumetric scan volume antennas often use multiple design features that make it difficult to achieve a low production cost. Dominant among these is the use of a single radiating element or unit cell at each transmit, receive, or T/R module interface, the use of many dielectric layers in a single or multiple assemblies, and the reliance on significant labor content for the radiator assembly.

In one implementation, a super-element radiator uses 130 elements or unit cells in a common assembly. The assembly uses metal extrusion and a simple two-layer dielectric assembly in order to minimize the parts count. And, final assembly is a short operation to attach the waveguide transitions and dielectric subassembly.

Figure 12:
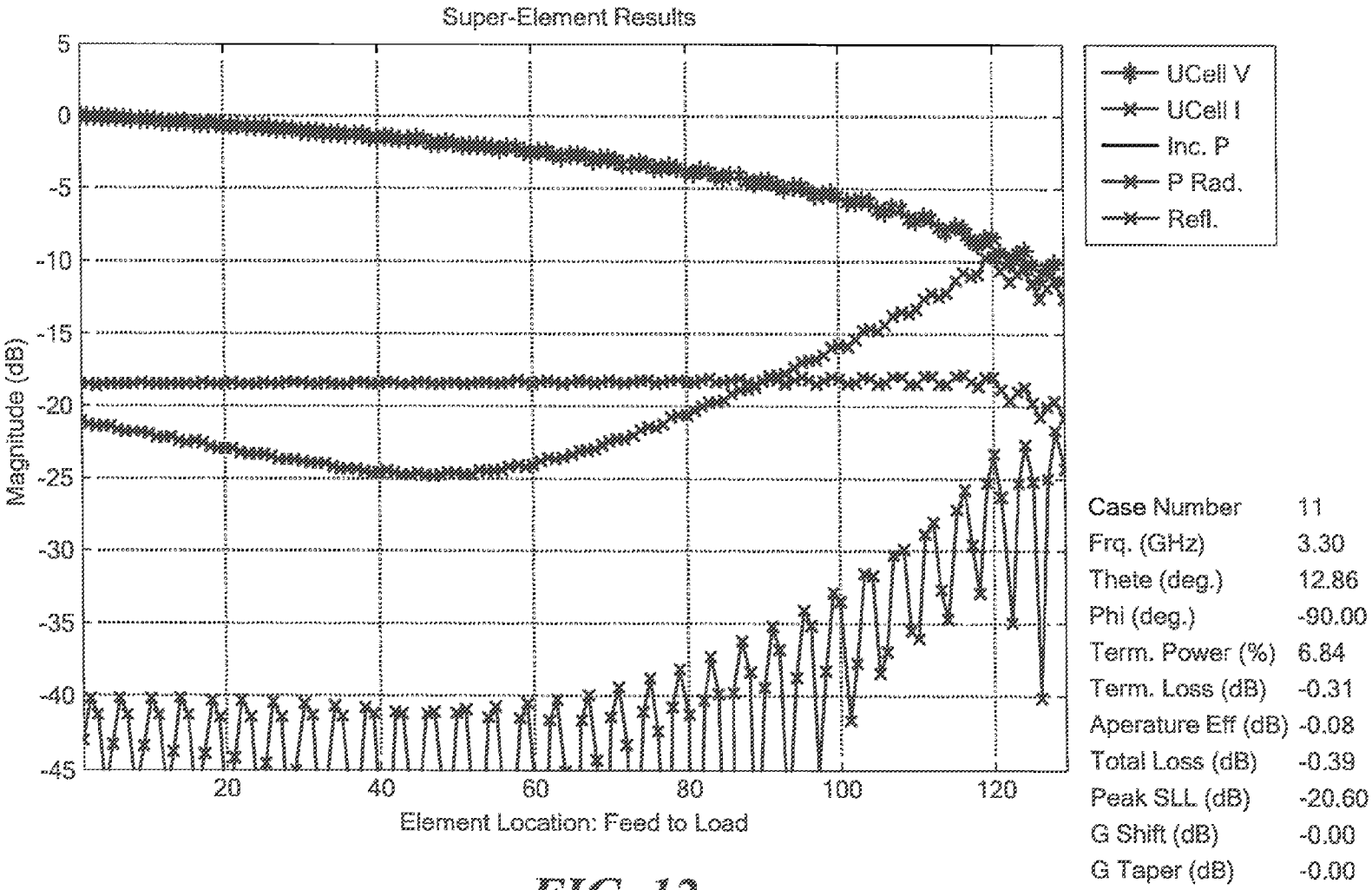
FIG. 12 shows super-element unit cell voltage, current, incident power, radiated power, and reflection coefficient.

Electrical performance for an exemplary super-element radiator can be summarized graphically. The total loss estimate, aperture efficiency, and array sidelobe levels as a function of operating frequency and scan angle in an infinite array environment are shown in FIGS. 11A-D. The fields, current, and power internal to the super-element are displayed as a function of the element position, starting at the feed port and ending at the termination, as shown in FIG. 12. In one embodiment, a total electrical loss is 1.8 dB or less for scan angles up to 65 degrees from an aperture surface normal when operated within S-Band frequencies over a 10% bandwidth.

Figure 13A:
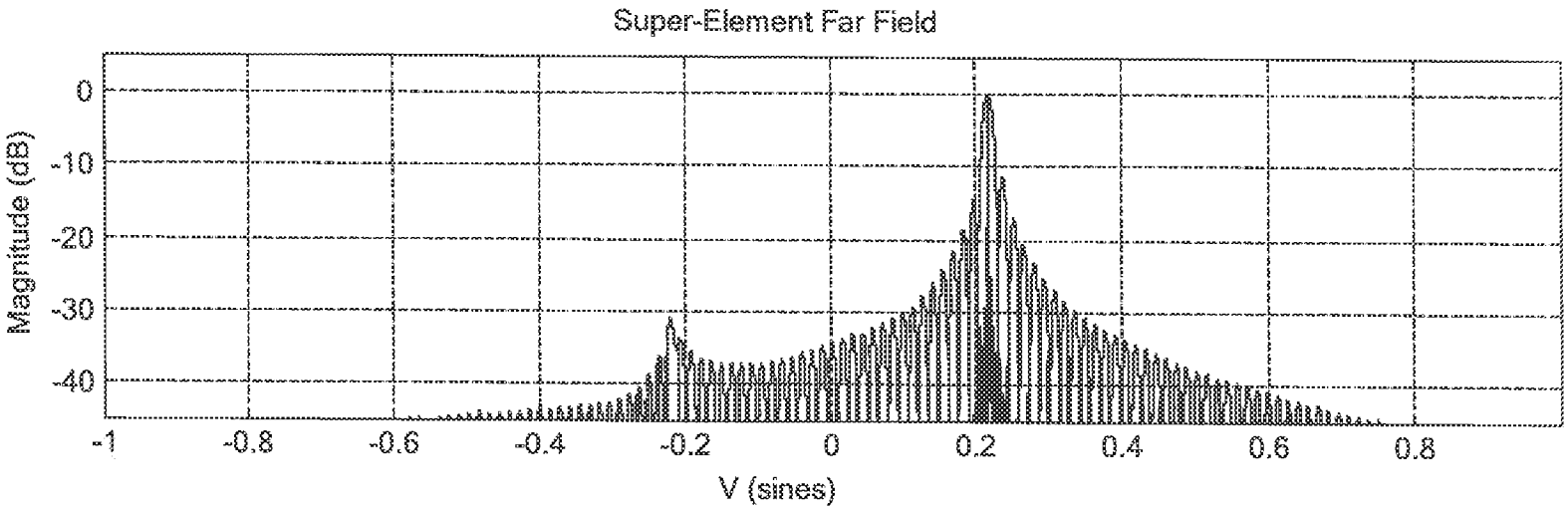
FIGS. 13A and 13B show super-element far field patterns.
Figure 13B:
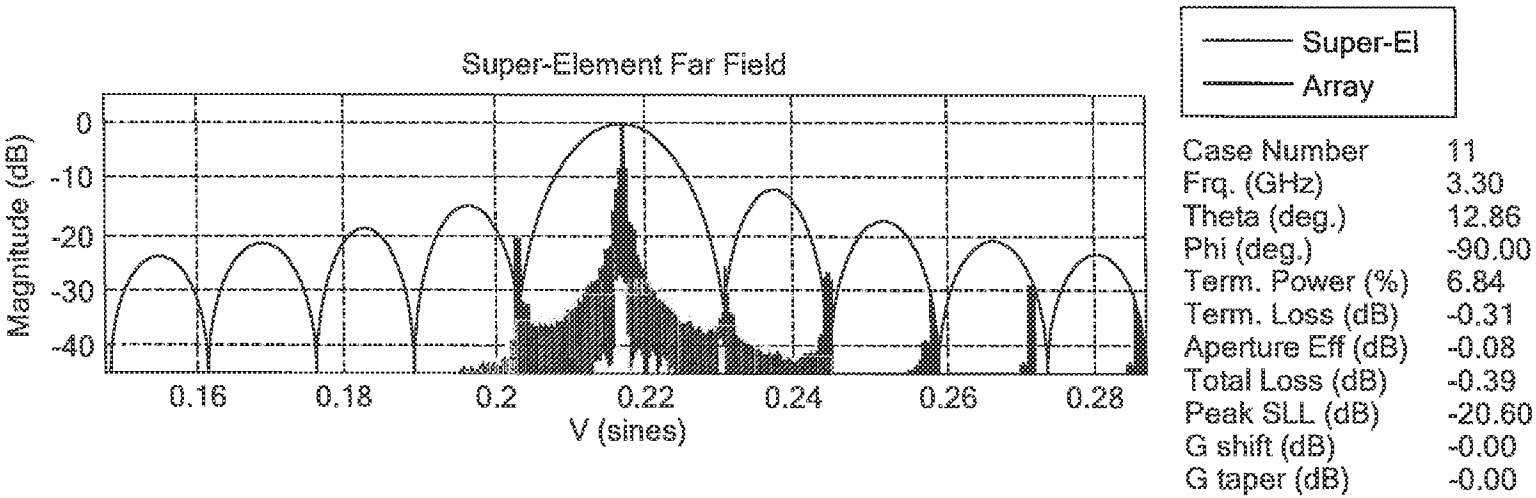
Figure 14:
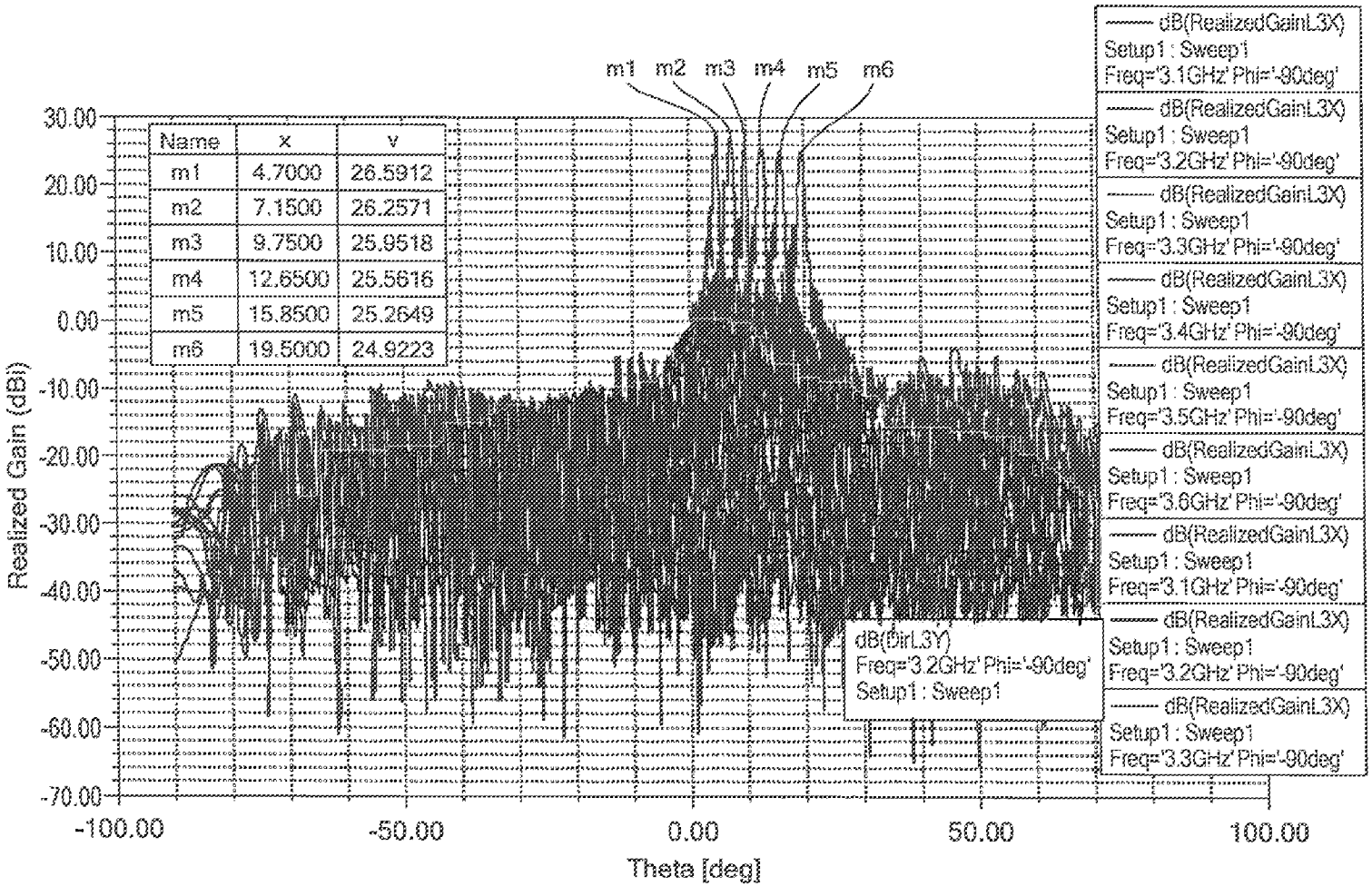
FIG. 14 shows super-element far field patterns for six equally spaced frequencies.

The inventive super-element far field radiation patterns have several unique features of note, as shown in FIG. 13. The far field pattern in the plane parallel to the long super-element axis is quite directive because of the element length. The main beam has a 3 dB beamwidth of less than 1 degree, and is positioned away from boresight (0 degrees), consistent with the scan volume. The antenna sidelobes generally follow a (sin x)/x function because of the high antenna aperture efficiency, with the exception of sidelobes having an approximately −30 dB magnitude at a location opposite that of the main beam. This cluster of sidelobes is caused by internal reflections within the super-element, and can be considered images of the main lobe or an image sidelobe group. Because the internal reflection coefficients are low, these also are at low levels relative to the main beam. FIG. 14 shows super-element and array far field patterns for six equally spaced frequencies over the operating band and at 0 degrees phase scan in an infinite array environment.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A super-element radiator assembly, comprising:

a ridged waveguide having a longitudinal axis aligned with a longitudinal axis of the super-element radiator assembly;

a series of slot couplers formed in the waveguide; and a dielectric assembly adjacent the ridged waveguide disposed between opposing conductive walls defining a long slot along a length of the super-element radiator assembly, the dielectric assembly comprising a first resonant conductive strip and a second resonant conductive strip, a first dielectric foam layer adjacent the waveguide, a first dielectric layer adjacent the first dielectric foam layer, a second dielectric foam layer adjacent the first dielectric layer, and a to second dielectric layer adjacent the second dielectric foam layer, the first and second resonant strips being aligned along the longitudinal axis of the super-element radiator assembly and separated by the second dielectric foam layer.

2. The assembly according to claim 1, wherein the first resonant conductive strip is disposed on the first dielectric layer.

3. The assembly according to claim 2, wherein the second resonant conductive strip is disposed on the second dielectric layer.

4. The assembly according to claim 1, wherein the first and second dielectric foam layers are thicker than the first and second dielectric layers.

5. The assembly according to claim 1, wherein the slot couplers are offset from the longitudinal axis of the waveguide.

6. The assembly according to claim 5, wherein the offset varies over a length of the super-element assembly.

7. The assembly according to claim 1, wherein the conductive walls are extruded aluminum.

8. The assembly according to claim 1, wherein the super-element forms a part of an aperture of a planar and/or conformal phased array radar.

9. The assembly according to claim 1, wherein a structure of the super-element assembly provides a mode-filter.

10. The assembly according to claim 1, wherein the long slot provides single and multiple forms of polarization control, including single linear, dual linear, single circular, and dual circular polarizations.

11. The assembly according to claim 1, wherein the super-element assembly includes below resonance and above resonance components to balance the frequency and scan dependent response of the assembly.

12. The assembly according to claim 1, wherein the super-element assembly includes unit cells combined by a series-fed network to form a super-element for a scanned and fixed beam type.

13. The assembly according to claim 12, wherein the series-fed network is reactive.

14. The assembly according to claim 1, wherein the super-element forms a part of a system having a terminal VSWR is no greater than 1.05.

15. The assembly according to claim 1, wherein a total electrical loss is 1.8 dB or less for scan angles up to 65 degrees from an aperture surface normal when operated within S-Band frequencies over a 10% bandwidth.

16. A method of providing a super-element radiator assembly, comprising:

providing a ridged waveguide having a longitudinal axis aligned with a longitudinal axis of the super-element radiator assembly;

providing a series of slot couplers formed in the waveguide; and providing a dielectric assembly adjacent the ridged waveguide disposed between opposing conductive walls defining a long slot along a length of the super-element radiator assembly, the dielectric assembly comprising a first resonant conductive strip and a second resonant conductive strip, a first dielectric foam layer adjacent the waveguide, a first dielectric layer adjacent the first dielectric foam layer, a second dielectric foam layer adjacent the first dielectric layer, and a second dielectric layer adjacent the second dielectric foam layer, the first and second resonant strips being aligned along the longitudinal axis of the super-element radiator assembly and separated by the second dielectric foam layer.

17. The method according to claim 16, wherein the slot couplers are offset from the longitudinal axis of the waveguide.

18. The method according to claim 16, wherein the long slot provides single and multiple forms of polarization control, including single linear, dual linear, single circular, and dual circular polarizations.

19. The method according to claim 16, wherein the super-element assembly includes below resonance and above resonance components to balance the frequency and scan dependent response of the assembly.

20. The method according to claim 16, wherein the super-element forms a part of a system having a terminal VSWR is no greater than 1.05.

* * * * *